US005375422A

United States Patent [19]

Butts

[11] Patent Number: 5,375,422

[45] Date of Patent: Dec. 27, 1994

[54] HIGH EFFICIENCY NITROGEN REJECTION UNIT

[76] Inventor: Rayburn C. Butts, 2500 N. Big Spring St. Ste. 230, Midland, Tex. 79705

[21] Appl. No.: 126,412

[22] Filed: Sep. 27, 1993

Related U.S. Application Data

[63] Continuation-in-part of Ser. No. 932,867, Aug. 20, 1992, Pat. No. 5,257,505, which is a continuation-in-part of Ser. No. 682,287, Apr. 9, 1991, Pat. No. 5,141,544.

[51] Int. Cl.[5] ..... F25J 3/02

[52] U.S. Cl. ..... 62/24; 62/37; 62/43

[58] Field of Search ..... 62/24, 37, 43

[56] References Cited

U.S. PATENT DOCUMENTS

| | | | |
|---|---|---|---|
| 3,625,016 | 12/1971 | Hoffman | 62/26 |
| 3,625,027 | 12/1971 | Hoffman | 62/16 |
| 3,901,673 | 8/1975 | Zahn et al. | 62/23 |
| 4,142,876 | 3/1979 | Zahn et al. | 62/23 |
| 4,203,741 | 5/1980 | Bellinger et al. | 62/24 |
| 4,203,742 | 5/1980 | Agnihotri | 62/24 |
| 4,411,677 | 10/1983 | Pervier et al. | 62/25 |
| 4,451,275 | 5/1984 | Vines et al. | 62/28 |
| 4,453,958 | 6/1984 | Gulsby et al. | 62/28 |
| 4,456,461 | 6/1984 | Perez | 62/28 |
| 4,526,595 | 7/1985 | McNiel | 62/28 |
| 4,609,390 | 9/1986 | Wilson | 62/24 |
| 4,657,571 | 4/1987 | Gazzi | 62/23 |
| 4,675,035 | 6/1987 | Apffel | 62/17 |
| 4,687,499 | 8/1987 | Aghili | 62/24 |
| 4,698,081 | 10/1987 | Aghili | 62/24 |
| 4,718,927 | 1/1988 | Bauer | 62/24 |
| 4,746,342 | 5/1988 | DeLong et al. | 62/24 |
| 4,762,543 | 8/1988 | Pantermuehl et al. | 62/28 |
| 4,851,020 | 7/1989 | Montgomery, IV | 62/24 |
| 4,854,955 | 8/1989 | Campbell et al. | 62/24 |
| 4,861,360 | 8/1989 | Apffel | 62/17 |
| 4,889,545 | 12/1989 | Campbell et al. | 62/24 |
| 4,936,888 | 6/1990 | DeLong | 62/24 |
| 4,948,405 | 8/1990 | Thompson | 62/43 |

*Primary Examiner*—Ronald C. Capossela
*Attorney, Agent, or Firm*—Marcus L. Bates

[57] ABSTRACT

A process for separating nitrogen and hydrocarbons from a mixture of gases by splitting the mixture into a plurality of separate streams and throttling the flow of each stream to achieve a selected variable flow rate therebetween. The plurality of separate streams are individually cooled by exchanging heat with a plurality of different process streams. The cooled streams are combined and expand into a separation column where nitrogen ascends the column and exits as a process stream while hydrocarbon descends the column to a reboiler thereof and exits as a process stream. The reboiler is used for cooling one of the separate streams. The hydrocarbon from the bottom of the column is expanded and used to cool a reflux condenser located inside the column and thereafter cools another of the streams before it is discharged from the process. The nitrogen process stream is used to cool another of the separated streams, and then is discharged from the process.

15 Claims, 2 Drawing Sheets

HIGH EFFICIENCY NITROGEN REJECTION UNIT

RELATED PATENT APPLICATIONS

This patent application is a continuation-in-part of my co-pending patent application Ser. No. 07/932,867, filed Aug. 20, 1992, now U.S. Pat. No. 5,257,505, issued Nov. 2, 1993 which in turn is a continuation-in-part of my patent application Ser. No. 07/682,287, filed Apr. 9, 1991, now U.S. Pat. No. 5,141,544, issued Aug. 25, 1992.

BACKGROUND OF THE INVENTION

This invention discloses a novel high efficiency nitrogen rejection unit by which varying amounts of excess nitrogen are removed from a natural gas stream. Transporting pipelines usually accept natural gas containing up to a maximum of four mole percent total inerts. In this disclosure, total inerts are calculated as the sum of carbon dioxide, nitrogen, helium and other non-hydrocarbon gases. Carbon dioxide is easily removed by various commercial methods, for example as taught in my co-pending patent application Ser. No. 07/932,867 filed Aug. 20, 1992 and my U.S. Pat. No. 5,141,544 issued Aug. 25, 1992, and by U.S. Pat. No. 4,762,543.

However, nitrogen, helium and argon are not as chemically reactive and, therefore, cannot be removed as easily or generally by the same methods as carbon dioxide. Nitrogen, helium, argon and other atomically light gases physically act in similar manners at very low temperatures, therefore it will be understood that reference only to nitrogen in the remainder of this description also includes these other gases.

Prior to the above intellectual property matters, commercial removal of nitrogen usually was accomplished by fractionation under cryogenic conditions, as seen, for example in U.S. Pat. Nos. 4,451,275, 4,526,595, 4,675,035, and 4,609,390. These previous nitrogen extraction methods achieve a high degree of nitrogen purity, but at a high cost in initial plant equipment and refrigeration horsepower. Examples of these and other processes are shown in the accompanying Prior Art Statement.

The nitrogen removal method and apparatus presented herein uses no external refrigeration equipment and is considerably less expensive than previously known conventional methods. The process of this invention utilizes a thermal drive mechanism comprising a series of Joule-Thomson expansion valves (sometimes hereinafter referred to as a JT valve), the optimum physical placement of cross heat exchangers, and computer-based automatic control of cross heat exchanger loading and temperature monitoring.

This invention differs from my above mentioned patents and patent application by the provision of method and apparatus that includes a modified thermal drive mechanism which utilizes a series of Joule-Thomson expansion valves and the optimum physical placement of cross heat exchangers, and computer-based automatic control of cross heat exchanger loading and temperature monitoring.

SUMMARY OF THE INVENTION

The present invention provides both method and apparatus for separating nitrogen and hydrocarbon vapor from a mixture thereof wherein the mixture enters the system at a relatively high pressure and provides the energy for effecting the separation by the employment of the Joule-Thomson effect to selected process streams.

More specifically, the process, according to the invention, comprises separation of a feed gas that is a mixture of nitrogen and hydrocarbon vapor. The feed gas is split into a plurality of separate streams, each of which is throttled to achieve a selected variable flow rate therebetween. Each of the split streams is cooled by exchanging heat with one or more of an exiting process stream. The cooled split streams, save one, are recombined and then the recombined cooled split streams expand to the internal pressure of a nitrogen rejection column where the nitrogen and hydrocarbon are separated and exit in separate streams therefrom. The one split stream is cooled by exchanging heat with other process streams, and expands to the internal pressure of the nitrogen rejection column at a location spaced several trays above the introduction of the recombined split streams. The separated nitrogen and hydrocarbon exit in separate streams from the nitrogen rejection column. The separated streams include a nitrogen outlet line, a low pressure sales gas outlet line, and a high pressure sales gas outlet line.

The nitrogen rejection column includes a novel internal reflux condenser at the upper end thereof with the lower end thereof terminating in a reboiler. The internal reflux condenser is supported interiorly within the upper end of the column and includes a chamber formed between parallel plate members. A first and second plurality of vertical tubes extend through the plate members. The first plurality of tubes communicate the interior of the rejection column immediately above and below the plate members and form a condensing surface. The second plurality of vertical tubes extend through the lower plate member and down the column to a vapor trap and forms a one way flow path for the descending liquid.

Accordingly, a primary object of the present invention is the provision of both method and apparatus for the separation of nitrogen and hydrocarbons from a mixture thereof, including a thermal drive mechanism for the process which utilizes a series of Joule-Thomson expansion valves and the judicious physical placement of cross heat exchangers.

Another object of the present invention is the provision of a system by which a separation process is carried out and wherein nitrogen and hydrocarbons are separated from a mixture thereof while utilizing the pressure drop of the various process streams for the thermal drive of the system.

A further object of this invention is the provision of a system for separating nitrogen and hydrocarbons from a relatively high pressure mixture thereof by splitting the mixture into a single stream and a plurality of streams, cooling each split stream of the mixture by expansion of various downstream process streams which exchange heat with the split streams, and then effecting a separation in an improved separation column by introducing the split streams at selected locations within the column.

A still further object of this invention is the provision of a method of separating nitrogen and hydrocarbons from a high pressure mixture thereof by utilizing the pressure drop of various process streams thereof for the thermal drive of the system and judiciously controlling the various flow rates throughout the process.

Another and still further object of this invention is the provision of a process by which nitrogen is removed from produced compressible fluid obtained from a wellbore by splitting the compressible fluid into a plurality of streams, cooling each split stream of the mixture by expansion of various downstream process streams which exchange heat with the split streams, and thereafter effecting a separation of the nitrogen from the residual compressible fluid in a separation column.

These and other objects and advantages of the present invention will become readily apparent to those skilled in the art upon reading the following detailed description and claims and by referring to the accompanying drawings.

The above objects are attained in accordance with the present invention by the provision of a method for use with apparatus fabricated in a manner substantially as described herein.

DETAILED DESCRIPTION OF THE PREFERRED EMBODIMENT

The figures of the drawings disclose apparatus made in accordance with this invention for removal of nitrogen from natural gas streams. As particularly seen diagrammatically illustrated in FIG. 1, a natural gas stream 1 enters a water dehydration and CO2 removal apparatus. A clean, dry mixture of nitrogen and hydrocarbons continues at feed gas stream 2, and through divider device V1 where part of the main flow is split away from feed gas stream 2. The remaining feed gas stream continues to a diverter valve device V2 where the main flow is split into a plurality of streams illustrated herein as three separate, parallel streams 3, 4 and 5. Heat exchangers A, B and C are connected in parallel respective to one another with the downstream side 6, 7 and 8 thereof being recombined at collection point V3. Heat exchangers D and E are series connected respective to one another and are connected to a first JT expansion device I, while heat exchangers A, B and C are connected to a second JT expansion device F.

A nitrogen rejection column G includes a novel internal reflux condenser K supported within the upper end thereof and is made in accordance with the present invention. The lower end of column G terminates in a reboiler, illustrated for convenience as the before mentioned exchangers D and E. Heat exchanger H has a secondary series connected respective to a third JT expansion device J, with the outlet thereof being connected to the novel reflux condenser K.

Figure 2:
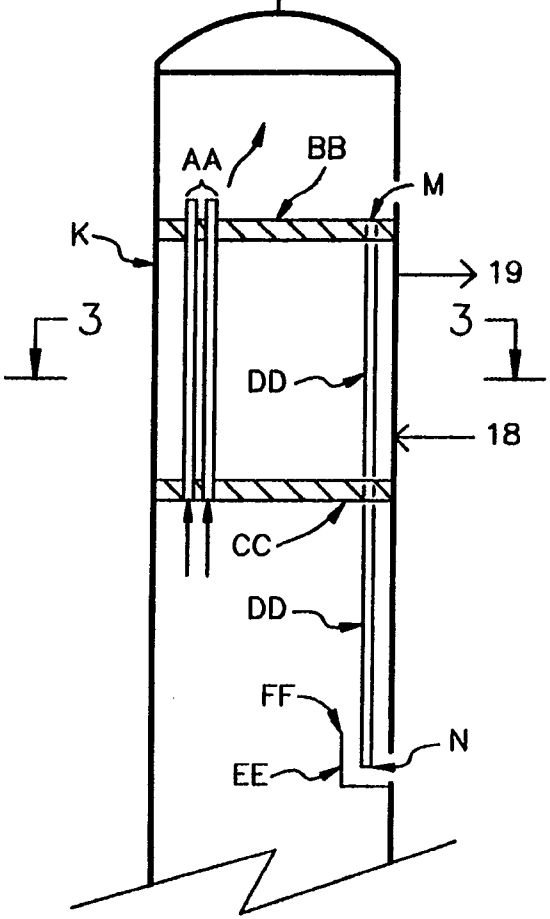
FIG. 2 is an enlarged, broken, diagrammatical representation showing the details of part of the apparatus of FIG. 1; and, FIG. 3 is a cross-sectional view taken along line 3—3 of FIG. 2.

As seen in FIG. 2, the internal reflux condenser K is disclosed diagrammatically in its simplest form. The condenser is supported interiorly within the upper marginal end of the column G and includes a chamber formed between spaced, parallel plate members BB and CC. Hence the interior wall surface of the column and the confronting faces of the plate members form a heat exchanger chamber within which a first and second plurality of vertical tubes AA and DD are exposed. Opposed ends of tubes AA extend through plate members BB, CC and communicate the interior of the tower immediately below plate CC and with the interior of the tower immediately above plate member BB. The upper ends of the plurality of vertical tubes AA extend a few inches above the plate member BB to trap liquid and in order to provide a low vapor velocity area to facilitate liquid-vapor separation.

A second plurality of vertical tubes DD each have an inlet end M that lays flush with the upper plate member BB, and an outlet end N at the lower end thereof that extends well below the lower plate member CC and into a liquid trap EE which is in the form of an upwardly opening container having overflow edge FF. The outlet end N of tubes DD is submerged within liquid contained within trap EE.

Figure 1:
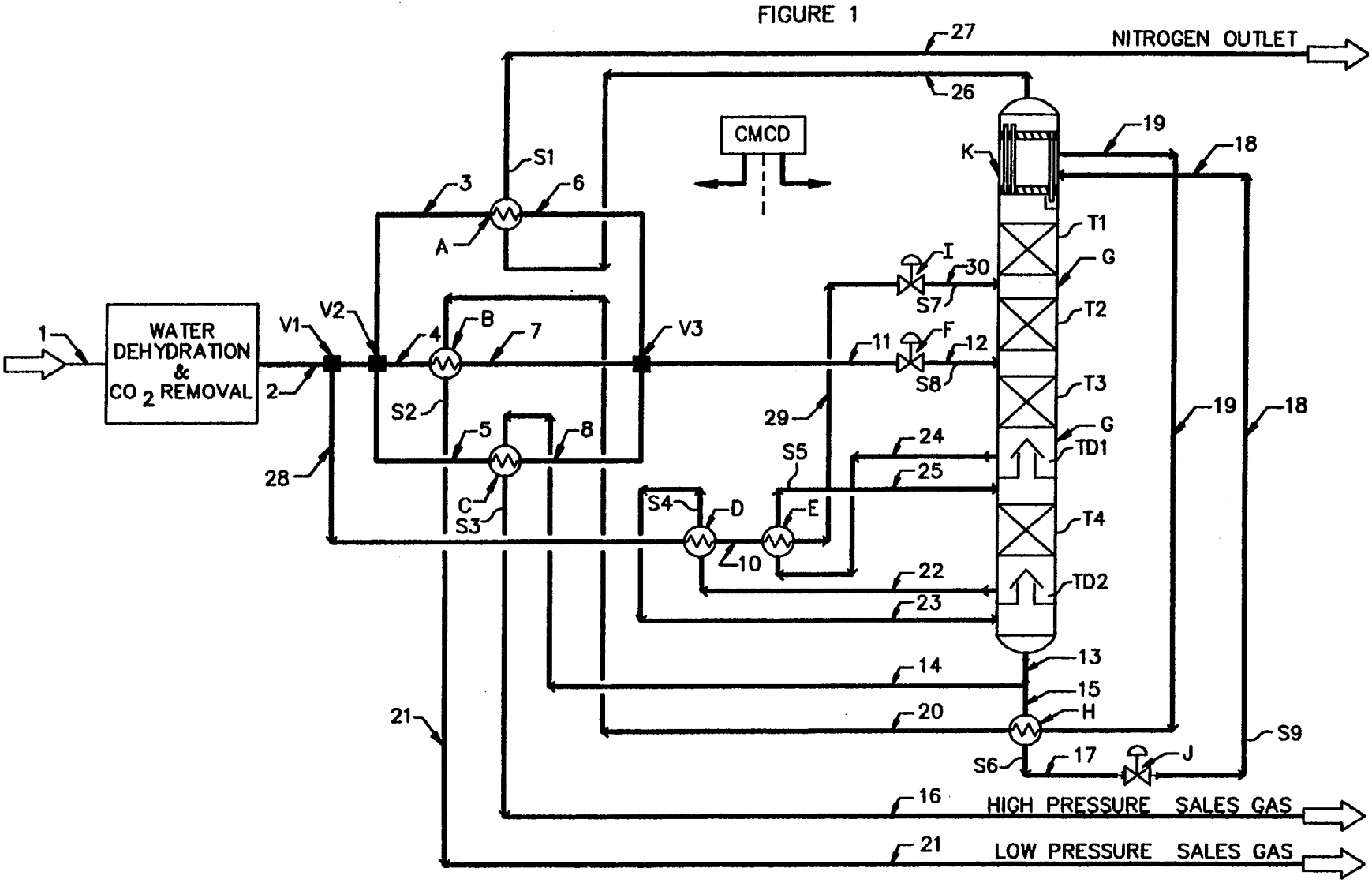
FIG. 1 of the drawing is a diagrammatical representation of a system made in accordance with the present invention for removing nitrogen and hydrocarbons from a mixture thereof.
Figure 3:
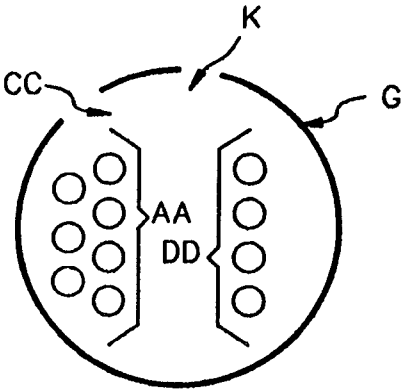

In FIG. 1, sensors S1, S2, S3, S4, S5, and S6 are connected to measure the temperature and pressure of the respective heat exchangers. Sensors S7, S8, and S9 are connected to measure the temperature and pressure of the respective JT expansion valves. The sensors and the stream splitters are connected to the computer means and control device CMCD for regulating the temperature, pressure, and flow rates of the appropriate process streams.

The nitrogen rejection unit produces no toxic or dangerous by products and often the feed stock, stream 1, is received at an elevated pressure so that little energy is consumed in the process.

OPERATION

This invention discloses an original technique for the efficient removal of nitrogen from natural gas streams without requiring rotating equipment or multiple fractionation columns. This technique includes a novel and useful apparatus by which a mixture of nitrogen and hydrocarbons are separated in a new and unobvious process.

According to this invention, nitrogen may be reduced from over 50 percent to less than 0.5 percent by volume in natural gas streams. The nitrogen reject stream discharged from this process typically has a purity of approximately 95 percent by volume.

Natural gas typically contains carbon dioxide and water vapor naturally occurring from the production reservoir. The water and carbon dioxide must first be removed before introduction into the nitrogen removal unit. This system is represented as stream 1 in FIG. 1. After the carbon dioxide and water are removed using conventional methods, it is represented as feed gas stream 2.

Feed gas stream 2 is now split into a plurality of streams including the one split stream at 28 and a plurality of streams 3, 4, and 5, which represent the main flow of the feed gas, all of which is controlled by computerized flow control techniques, using computer means known to those skilled in the art. The plurality of streams include a first split stream 3 which enters the primary side of heat exchanger A where heat is removed from the first stream 3 by being absorbed into the nitrogen rich stream 26, as will be explained later on in this disclosure. A second split stream 4 enters heat exchanger B where heat is rejected to a low pressure residue gas stream 20 from heat exchanger H. A third split stream 5 enters heat exchanger C where heat is removed or absorbed into the high pressure residue stream 14 from the column bottom. Streams 1, 2, 3, 4, 5, and 28 are at a pressure between 700 and 1200 PSIA (pounds per square inch absolute) and a temperature between 80 to 120 degrees F.

Streams 6, 7, 8, and 11 exist at between −60 degrees F. and −150 degrees F. and at a pressure only slightly lower than in streams 3, 4, and 5, respectively. Stream 6, 7, and 8 recombine at V3 to form stream 11 which enters pressure reducing JT valve F. Pressure reduced in JT valve F reduces the pressure from the inlet 700 to 1200 PSIA to approximately 315 PSIA and exits pressure control valve F as stream 12. This further cools stream 12 due to the JT effect as stream 11 expands to the column internal pressure.

Fourth split stream 28 exits the dividing device V1 and is routed to heat exchanger D where heat is removed from stream 28 and rejected into stream 22. Stream 22 enters heat exchanger D at a temperature of between −100 degrees F. to −200 degrees F. Stream 10 exits heat exchanger D and enters heat exchanger E where heat is again rejected from stream 10 and absorbed into stream 24. Stream 10 exits heat exchanger E as stream 29 at a temperature of −125 degrees F. to −200 degrees F.

Stream 29 continues to pressure reducing JT device I where pressure and temperature are further reduced. Stream 29 exits the device I as stream 30 at a temperature of between −200 degrees F. and −250 degrees F., and at a pressure of approximately 315 PSIA. Stream 30 then enters the tower G at an intermediate location that is above the tower entrance of stream 12 and below reflux condenser K.

Streams 12 and 30 enter at the illustrated intermediate feed stream locations on the nitrogen rejection tower G and are spaced at least one and preferably three trays apart. The nitrogen rejection tower G utilizes the before mentioned internal reflux condenser seen at K. Streams 12 and 30 enter column G as two phase fluid streams that are partly liquid and partly vapor. The liquid naturally falls by gravity downward inside tower G where the liquid is stripped of nitrogen by contact with the rising vapor generated and introduced lower in the column. Approximately 3 separation stages or trays T2 are located in the column between the feed location of stream 30 and the feed location of stream 12. The illustrated liquid draw tray TD1 enables stream 24 to exit the tower. Stream 24 enters heat exchanger E where heat is absorbed into stream 24 from stream 10. Temperature in stream 24 is approximately −200 degrees F. to −225 degrees F. and stream 25 is −180 degrees F. to −215 degrees F. Stream 25 reenters tower G below the liquid draw tray TD1 as a two phase fluid. The vapor continues up the tower to strip the nitrogen from the falling liquid from streams 12 and 30 as mentioned above.

The liquid from stream 25 continues down the tower another approximate six stages or trays through T4 where the nitrogen is stripped by vapor rising up the column as generated in the reboiler, (heat exchanger D). The column liquid is removed from column G by means of the liquid draw tray TD2 and exits as stream 22 where it enters heat exchanger D and exits the exchanger as stream 23. Stream 23 is a two phase fluid and is routed back to the lower portion of the column below liquid draw tray TD2 for separation. The temperature of stream 22 is approximately −200 degrees F. to −225 degrees F. and the temperature in stream 23 is approximately −160 degrees F. to −195 degrees F.

Stream 13 is predominately hydrocarbon and exits the bottom of the nitrogen rejection column G where it is divided into streams 14 and 15. Stream 14 continues to heat exchanger C where heat is absorbed from stream 5. Stream 14 exits device C as stream 16 at a temperature of 60 to 100 degrees F. and a pressure of approximately 300 PSIA. The processed stream 16 is discharged from the system as high pressure sales gas outlet and represents the main product manufactured with this process.

Stream 15 continues to heat exchanger H where it is subcooled to approximately −200 degrees F. and exits as stream 17. Stream 17 then enters JT expansion valve J where the pressure is reduced to near 25 PSIA and at a temperature of approximately −250 degrees F. Stream 18 is then routed to the internal reflux condenser equipment K. The condenser equipment K is utilized to provide the required cooling to the nitrogen rejection tower by controlled overhead condensation or cooling. This equipment K absorbs heat from the tower overhead vapor and condenses hydrocarbon vapor entering the inlet of tubes AA at the lower part of the condenser K.

Referring to FIG. 2 for further details on the internal reflux condenser K, the column vapor enters the lower part or tube sheet of the heat exchanger CC. The vapor continues up the inside of the heat exchanger tubes AA where hydrocarbon condensation occurs on the internal wall surface of the tubes. During low inlet flow operation, the condensed liquid will flow counter current to the vapor flow and gravitate downward where it will fall to the column internals below tube sheet CC.

During higher flows, the liquid will be condensed and carried upward along with the gas vapor. The condenser tubes are designed to extend 3 to 4 inches beyond the top tube sheet labeled BB. This extension is necessary in order to provide a location below the upper ends of the tubes AA for separation of liquid and vapor.

In addition, in order for the trapped liquid to return to the column trays, a second set of tubes DD is provided and installed flush with the top tube sheet labeled BB. The lower marginal length of tubes DD extend below the lower tube sheet labeled CC. The purpose of tubes DD is to provide a flow path for condensate liquid to be transferred through the tube sheets BB and CC, as shown. The lower end of tubes DD are installed in a seal pan and form a liquid trap which is shown as EE on FIG. 2. The liquid trap EE maintains a liquid seal on the lower end of tubes DD to prevent upward liquid flow through tubes DD. The liquid trap EE preferably is upwardly opening as shown, and can overflow the edge FF as required.

Cooling is provided to the reflux condenser equipment K by absorbing heat into stream 18 which enters the lower part of the shell side of condenser equipment K near lower tube sheet CC. Heat is absorbed into this two phase fluid as explained earlier in conjunction with the reflux condenser K located at the top of tower G.

The fluid in stream 18 exits the reflux condenser K as stream 19. Stream 19 temperature is approximately −200 degrees F. Stream 19 enters heat exchanger H (FIG. 1) where heat is absorbed into stream 19 and exits exchanger H as stream 20.

Stream 20 continues to heat exchanger B where heat is absorbed from process stream 4. Stream 20 exits exchanger B as product stream 21. This stream 21 is one of two product streams 16 and 21. Stream 21 exits the nitrogen rejection column at near 20 PSIA and 60 to 100 degrees F., while stream 16 exits the plant at near 30 psi and 60 to 100 degrees F. Stream 26 exits the tower G overhead as the nitrogen rich or nitrogen reject stream.

Stream 26 is routed to heat exchanger A where heat is absorbed from Stream 3. Stream 27 exits the exchanger A at approximately 100 degrees F. and near 300 PSIA.

Those skilled in the art, having digested this disclosure, will appreciate that employment of the reflux condenser K together with the four split streams 3, 4, 5, 28 which are arranged to enter column G at intermediate locations 12 and 30 provide a useful and heretofore unknown process by which nitrogen is removed from natural gas to thereby provide unexpected results that include a more useful product at a minimum investment in process equipment.

I claim:

1. A system for separating nitrogen and hydrocarbon from a mixture thereof, comprising:

means for elevating the pressure of said mixture to provide a feed gas stream; first, second, third, and fourth heat exchangers having a primary side and a secondary side, with said secondary side thereof being connected to exchange heat with a downstream process stream;

means splitting said feed gas stream into a first, second, third, and fourth stream and connecting said first, second, third, and fourth stream, respectively, to the primary side of said first, second, third, and fourth heat exchangers, respectively, and to throttle the flow of said first, second, third, and fourth and thereby achieve a selected flow ratio therebetween;

a separator column having a reflux condenser connected at the top thereof and a column bottom heat exchanger connected at the bottom thereof;

first expansion valve means connecting the primary of said first heat exchanger to expand to the internal pressure of said separator column and thereby reducing the temperature of the fluid flowing through the column; second expansion valve means connecting the primary of said second, third, and fourth heat exchangers to expand to the internal pressure of said separator column and reducing the temperature of the fluid flowing through the column; and a third expansion valve means;

a high pressure residue stream connecting the column bottom to the secondary of said fourth heat exchanger and then to a high pressure sales gas outlet;

said column bottom heat exchanger having a primary side and a secondary side; means connecting the column bottom to said secondary of said column bottom heat exchanger and then through said third expansion valve means to expand into said reflux condenser and return as a low pressure residue stream connecting the primary of said column bottom heat exchanger to a low pressure sales gas outlet;

a nitrogen gas outlet; means connecting the top of the separator column to the secondary of said first heat exchanger to thereby cool the fluid flowing through the primary of the first heat exchanger, and then to said nitrogen gas outlet;

and means by which said means splitting said feed gas stream, said expansion valves, and said reflux condenser temperature are adjusted within an optimum range for separating the nitrogen from the mixture.

2. The system of claim 1 wherein the flow rates through the heat exchangers and the expansion valves are controlled to provide an optimum condition for separation of the nitrogen and hydrocarbons by the provision of sensor means to measure the fluid temperatures exiting the first, second, third, and fourth heat exchangers and control parameters as required to control the expansion valve means controller means; connected to control the flow rate through said heat exchangers and through said expansion valves and thereby select the optimum condition of operation.

3. The system of claim 1 wherein one said heat exchanger includes a pair of heat exchangers having series connected primary sides and parallel connected secondary sides, one secondary side being a lower column reboiler and the other secondary side being connected to an upper column reboiler to adjust the temperature of the stream connected to the first expansion valve means within an optimum range; flow from said upper and lower reboilers into the column being separated by at least one column tray.

4. A process for separating nitrogen and hydrocarbon from a mixture thereof and flowing the separated nitrogen to a nitrogen discharge and flowing the separated hydrocarbon to a hydrocarbon discharge, comprising the steps of:

adjusting the pressure of said mixture to provide a relatively high pressure feed gas respective to the nitrogen and hydrocarbon discharge pressure; splitting the feed gas into a plurality of separate streams and throttling the flow of each of said separate streams to achieve a selected variable flow rate therebetween;

connecting the secondary of a plurality of heat exchangers to exchange heat with a nitrogen rejection column; cooling said plurality of separate streams by exchanging heat with respective ones of the primary of said plurality of heat exchangers;

expanding one cooled split stream to the internal pressure of said nitrogen rejection column and thereby reducing the temperature of the fluid flowing through said nitrogen rejection column;

recombining the other cooled split streams and thereafter expanding the recombined cooled split streams into said nitrogen rejection column to further lower the temperature thereof;

whereby the lighter fractions including nitrogen ascend in the nitrogen rejection column while the heavier fractions, including hydrocarbon, descend in the nitrogen rejection column and flow through a reboiler thereof; said reboiler includes one of said heat exchangers;

cooling the hydrocarbon from the nitrogen rejection column bottom by flowing the cooled hydrocarbons through one of said heat exchangers, and expanding the cooled hydrocarbons into an internal reflux condenser located within said nitrogen rejection column, thereby cooling the internal reflux condenser, and then through the secondary side of one of said plurality of heat exchangers, and then to the hydrocarbon discharge; and, passing separated nitrogen from the nitrogen rejection column, through the secondary of one of the recited heat exchangers, and to the nitrogen discharge.

5. The process of claim 4 and further including the steps of compressing and cooling the inlet mixture to achieve an inlet stream having about 900 PSI and 100 degrees F.;

arranging said plurality of streams to include a first, second, third, and fourth stream, respectively, connected to a first, second, third, and fourth heat exchanger primaries, respectively; and further including flowing part of the high pressure feed gas directly to the respective heat exchanger that is connected to the reboiler to thereby maintain the reboiler at an optimum temperature.

6. The process of claim 4 and further including the steps of connecting the reflux condenser outlet of the nitrogen rejection column to the secondary of at least one of the heat exchangers, then to the hydrocarbon discharge.

7. The process of claim 4 and further including the step of using the upper end of the nitrogen rejection column as the internal reflux condenser by placing transverse spaced plate members within the upper marginal end of the interior of the nitrogen rejection column, flowing fluid up through the internal reflux condenser by connecting a first group of tubes between the plate members through which vapors can pass upward therethrough while condensate collects on the upper plate member;

flowing the condensate down through the internal reflux condenser by connecting a second group of tubes between the plate members through which liquid can gravity flow downwardly therethrough while vapors cannot pass upward therethrough;

controlling the flow ratio of the split streams to regulate the temperature thereof, the pressure drop of each expansion step, and the reboiler temperature within a range that optimizes the separation operation.

8. A method of improving the quality of a mixture of high pressure feed gas that includes nitrogen and hydrocarbon by separating the nitrogen and hydrocarbon from said mixture; and flowing the separated nitrogen to a nitrogen discharge outlet means and flowing the separated hydrocarbon to a hydrocarbon discharge means, comprising the steps splitting said feed gas into a plurality of streams that include a first split stream and three other split streams; and, throttling the flow of each of said split streams to achieve a selected variable flow rate therebetween; cooling each of the split streams by passing the first split stream through the primary of a first heat exchanger, and passing the three other split streams, respectively, through the primary of a second, third, and fourth heat exchanger, respectively;

arranging the primaries of said heat exchangers in parallel relationship respective to one another; recombining the cooled three split streams and thereafter expanding the recombined split streams into a nitrogen rejection column to remove heat therefrom; where the lighter fractions, including nitrogen, ascend the nitrogen rejection column while the heavier fractions, including hydrocarbon, descend the nitrogen rejection column and flow through a reboiler thereof;

placing a reflux condenser at the top of said nitrogen rejection column; cooling the separated hydrocarbon flowing from the nitrogen rejection column by expanding the hydrocarbon into the reflux condenser;

passing the separated nitrogen flowing from the nitrogen rejection column through a second of said heat exchangers and then to said nitrogen discharge, and flowing the separated hydrocarbon from the reflux condenser through a secondary of one of the heat exchangers and then to the hydrocarbon discharge.

9. The method of claim 8 and further including the step of controlling the flow rates of the split streams with a computer means that modifies the ratio of the high pressure feed gas routed to each exchanger in response to changing temperature parameters encountered during the normal operation of the process.

10. The method of claim 8 and further including the step of controlling the flow rate of the four split streams to regulate the temperature thereof, the pressure drop occasioned by each expansion step, and a reboiler temperature within a range that optimize the separation operation.

11. The method of claim 8 and further including the step of using the upper end of the nitrogen rejection column as the internal reflux condenser by placing transverse spaced plate members within the upper marginal end of the interior of the nitrogen rejection column, flowing fluid up through the internal reflux condenser by connecting a first group of tubes between the plate members through which vapors can pass upward therethrough while condensate collects on the upper plate member;

flowing the condensate down through the internal reflux condenser by connecting a second group of tubes between the plate members through which liquid can gravitate downwardly therethrough while vapors cannot pass upward therethrough;

controlling the flow rate of the three split streams to regulate the temperature thereof, the pressure drop across each expansion valve, and the reboiler temperature within a range that optimize the separation operation.

12. A method of separating nitrogen and hydrocarbon from a feed gas containing a mixture thereof and flowing the separated nitrogen and the separated hydrocarbon to separate collection means, comprising the steps of:

splitting a stream of relatively high pressure feed gas into a first split stream and a plurality of split streams to achieve a selected variable flow rate therebetween;

cooling the first split stream by passing the first split stream through a heat exchanger in which heat is exchanged with a downstream process stream, then expanding the cooled first split stream into a nitrogen rejection column to further reduce the temperature thereof;

cooling each of the plurality of split streams by passing each of the plurality of split streams through a respective one of a plurality of heat exchangers in which heat is exchanged with a downstream process stream, combining the plurality of cooled split streams, further cooling the combined split streams by expanding the cooled combined streams into the nitrogen rejection column to further reduce the temperature thereof to effect separation of the nitrogen and hydrocarbon which then exit in separate streams therefrom;

expanding one of the separate streams exiting from the separation column to reduce the temperature thereof and using the expanded stream for cooling an internal reflux condenser located in the nitrogen rejection column; and flowing the expanded stream from the condenser and using the expanded stream for the recited step of cooling one of the split streams, and flowing the expanded stream to one of said separate collection means;

flowing another of the separate streams exiting from the separation column for the recited step of cooling another one of the split streams by flowing the another of the separate streams through the secondary of a heat exchanger having a primary through which one of the split streams flows in heat transfer relationship therewith; and then flowing the stream to another one of said separate collection means;

carrying out the step of cooling one of the split streams by connecting the secondary of the heat exchanger thereof as the reboiler for the nitrogen rejection column.

13. The method of claim 12 and further including the steps of controlling the flow rates of the split streams with a computer device that modifies the amount of feed gas routed to each exchanger in response to changing temperature parameters encountered during the normal facility operation.

14. The method of claim 12 and further including the steps of controlling the flow rate of each of the split streams to regulate the temperature thereof, the pressure drop across each expansion step, and the reboiler temperature within a range that optimize the separation operation.

15. The method of claim 12 and further including the step of using the upper end of the nitrogen rejection column as the internal reflux condenser by placing transverse spaced plate members within the upper marginal end of the interior of the nitrogen rejection column, flowing fluid up through the internal reflux condenser by connecting a first group of tubes between the plate members through which vapors can pass upward therethrough while condensate collects on the upper plate member;

flowing the condensate down through the internal reflux condenser by connecting a second group of tubes between the plate members through which liquid can gravitate downwardly therethrough while vapors cannot pass upward therethrough;

controlling the flow rate of the three split streams to regulate the temperature thereof, the pressure drop across each expansion valve, and the reboiler temperature within a range that optimize the separation operation.

* * * * *